United States Patent [19]

Nakamura et al.

[11] Patent Number: 4,561,840

[45] Date of Patent: Dec. 31, 1985

[54] SAFETY DEVICE FOR OIL BURNER

[75] Inventors: Kazuharu Nakamura; Yoshimasa Tsuboi, both of Nagoya, Japan

[73] Assignee: Toyotomi Kogyo Co., Ltd., Aichi, Japan

[21] Appl. No.: 586,018

[22] Filed: Mar. 5, 1984

[30] Foreign Application Priority Data

Mar. 4, 1983 [JP] Japan ..... 58-31861[U]

[51] Int. Cl.[4] ..... F23N 5/24

[52] U.S. Cl. ..... 431/22; 431/25; 431/78; 431/333

[58] Field of Search ..... 431/12, 22, 25, 59, 431/78, 80, 333; 340/579, 228.1; 328/6

[56] References Cited

U.S. PATENT DOCUMENTS

| | | | |
|---|---|---|---|
| 2,705,296 | 3/1955 | Weber | 431/25 X |
| 2,812,015 | 11/1957 | MacCracken | 431/78 |
| 3,610,792 | 10/1971 | Risse | 431/22 X |
| 3,843,308 | 10/1974 | Graham et al. | 431/22 |
| 4,034,235 | 7/1977 | Wade | 431/25 X |
| 4,437,829 | 3/1984 | Baker | 431/22 X |
| 4,449,919 | 5/1984 | Takikawa et al. | 431/76 |

FOREIGN PATENT DOCUMENTS

| | | | |
|---|---|---|---|
| 52-53008 | 12/1977 | Japan . | |
| 55-1491 | 1/1980 | Japan . | |
| 3831 | 1/1981 | Japan | 431/22 |

*Primary Examiner*—Randall L. Green

*Attorney, Agent, or Firm*—Pollock, Vande Sande & Priddy

[57] ABSTRACT

A safety device for an oil burner is disclosed which is capable of effectively and rapidly accomplishing the detecting and stopping of abnormal combustion in the oil burner. The safety device includes an additional flame electrode (72) which is adapted to flow a DC current therethrough when flame of abnormal combustion contacts with the electrode, to thereby detect the abnormal combustion.

9 Claims, 4 Drawing Figures

SAFETY DEVICE FOR OIL BURNER

DESCRIPTION

1. Technical Field

This invention relates in general to safety devices for oil burners. More particularly, the invention concerns such devices which are adapted to rapidly detect abnormal combustion in the burner and to interrupt the supply of fuel oil thereto, to thereby stop the abnormal combustion.

2. Background Art

Conventionally, a high limit switch has been often used in the art as a means for detecting abnormal combustion operation. One of such conventional high limit switches is adapted to detect an abnormal increase in the temperature of a heat exchanger or a frame of an oil burner to stop the combustion operation. Such a high limit switch has a disadvantage that the detection of abnormal combustion is delayed so that a large amount of incomplete combustion gas is generated, because an abnormal increase in temperature of the heat exchanger or frame indicates that abnormal combustion has already occurred. Another conventional high limit switch is adapted to detect abnormal combustion of an oil burner utilizing an auxiliary flame electrode. This type of high limit switch causes an undesirable increase in the manufacturing cost, thus causing the oil burner to be rather expensive.

Accordingly, it would be highly desirable to develop a simple, inexpensive safety device for an oil burner which is capable of effectively and rapidly detecting and stopping abnormal combustion in the burner.

DISCLOSURE OF THE INVENTION

An object of the present invention is to provide a safety device for an oil burner which is capable of rapidly detecting abnormal combustion in the oil burner to substantially prevent incomplete combustion.

Another object of the present invention is to provide a safety device for an oil burner which is capable of reliably accomplishing the detecting and stopping of abnormal combustion in the oil burner.

A further object of the present invention is to provide a safety device for an oil burner which is capable of effectively carrying out the abovementioned objects with a simple structure.

These objects of the invention are given only by way of example. Thus, other desirable objectives and advantages inherently achieved by the disclosed structure may occur or become apparent to those skilled in the art. Nonetheless, the scope of the invention is to be limited only by the appended claims.

In accordance with the present invention, there is provided a safety device for an oil burner which is adapted to apply AC voltage between the body of the burner and a first flame electrode extending from the burner body into the flame formed during normal combustion in the burner body. The first flame electrode is electrically insulated from the burner body to detect a DC flame current therethrough. The safety device further comprises a second flame electrode of an at least two dimensional shape arranged above the burner body at a position to which a flame formed during normal combustion does not extend. The second flame electrode also is electrically insulated from the burner body.

In accordance with another aspect of the present invention, there is provided a safety device for an oil burner which is adapted to apply AC voltage between the body of the burner and a first flame electrode extending from the burner body into the flame formed during normal combustion in the burner body. This first flame electrode also is electrically insulated from the burner body to detect a DC flame current therethrough. This embodiment of the safety device further comprises a second flame electrode arranged substantially concentrically with but above and in front of the burner body. This second flame electrode also is insulated from the burner body. This embodiment of the safety device detects abnormal combustion of the oil burner utilizing the increase in a DC current flowing through the second flame electrode to stop the abnormal combustion.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate the same or corresponding parts throughout the figures and wherein.

BEST MODE FOR CARRYING OUT THE INVENTION

Figure 1:
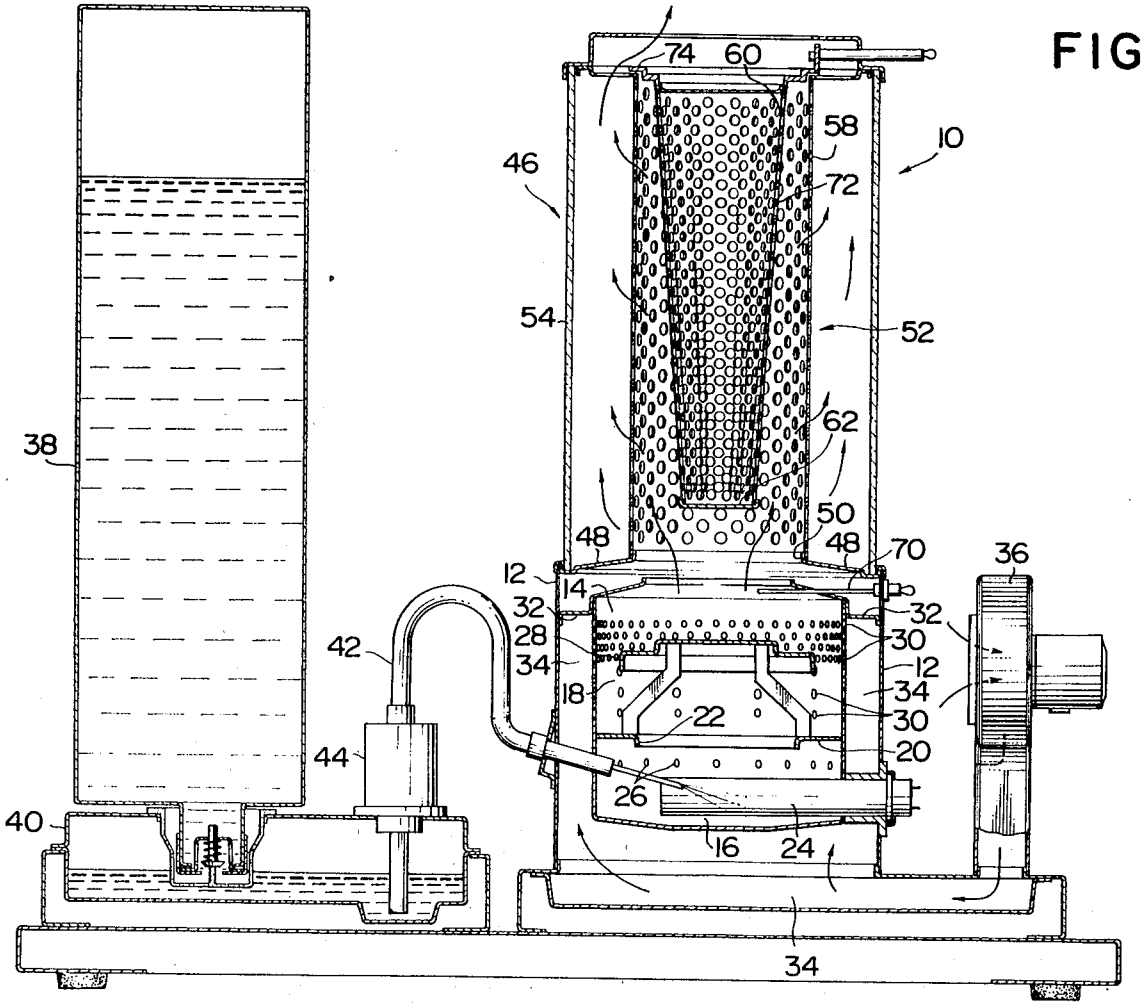
FIG. 1 is a vertical sectional view showing an oil burner comprising one embodiment of a safety device according to the present invention.

FIG. 1 illustrates an example of an oil burner 10 in which a safety device according to the present invention is adapted to be incorporated. Oil burner 10 is generally in the form of a red-heated oil-fired space heater; however, it should be noted that an oil burner in which a safety device of the present invention is to be employed is not limited to such a red-heated space heater.

Oil burner 10 includes a housing 12 and a burner body 14 received in the housing. In the illustrated example, burner body 14 comprises a pot adapted to accomplish not only the vaporization and ignition of fuel oil such as kerosene supplied thereto, but also the combustion of vaporized fuel oil therein. Pot 14 has a lower chamber 16 and an upper chamber 18 formed therein which are separated from each other by a horizontal partition 20 having an opening 22 formed at the central portion thereof, through which chambers 16 and 18 are communicated with each other. Lower chamber 16 has an electric heater 24 arranged therein which acts to heat fuel oil supplied to pot 14 to vaporize it and ignite the vaporized fuel oil using air mainly supplied from through-holes 26 formed at the side wall of lower chamber 16. In a pot 14 having a height and diameter of about 10 cm., approximately 18 holes 26 may be provided, each being about 1.3 cm. in diameter. Upper chamber 18 has a plate means 28 arranged therein above the opening 22 and formed into an inverted dish shape to spread the flames from fuel oil ignited in the lower chamber 16 and carry out substantial combustion of vaporized fuel oil using air supplied thereto via a plurality of through-holes 30 formed at the side walls thereof. In a pot 14 of the size mentioned, approximately seven staggered rows of holes 30 may be provided, the upper four rows having 56 holes each with a diameter of about 1.1 cm. in the first two rows and about 1.5 cm. in the next two rows; the lower three rows having approximately 9 holes each with a diameter of about 1.5 cm. in the fifth and sixth rows and about 1.2 cm. in the seventh row. In all the rows, the holes are more or less equally spaced about the circumference of pot 14.

In the illustrated example, burner body or pot 14 is suspended in housing 12 by means of an annular top plate 32 which extends from pot 14 to housing 12, so that an annular air supply passage 34 is defined between housing 12 and pot 14, to supply air received from a fan 36 through holes 26 and 30 to the interior of pot 14. During normal combustion within oil burner 10, flames formed in pot 14 extend only to the upper edge of top plate 32.

Oil burner 10 also includes an oil supply means for supplying fuel oil to pot 14. The oil supply means comprises an oil tank 38, an oil reservoir 40 and an oil supply pipe 42. Oil reservoir 40 permits tank 38 to be supported thereon in an inverted manner and keeps the level of fuel oil constant therein. Fuel oil is forcedly supplied by means of an electromagnetic pump 44 provided between oil supply pipe 42 and oil reservoir 40.

Further, oil burner 10 includes a multiple combustion cylinder construction 46 supported on an annular top plate 48 of housing 12, at the central portion of which an opening 50 is formed to communicate pot 14 therethrough with the combustion cylinder construction. Combustion cylinder construction 46 is adapted to emit heat rays therefrom to ambient. More particularly, construction 46 includes a red-heated cylinder means 52 and a heat-permeable cylinder 54 arranged to surround cylinder means 52 with a space being defined therebetween. Cylinder means 52 comprises an outer perforated cylinder 58 and an inner perforated cylinder 60 disposed concentrically with outer cylinder 58 and provided with a seal plate 62 attached to the lower end thereof. In construction 46, heat generated due to combustion in pot 14 heats cylinders 58 and 60 to a red-hot condition, to thereby allow cylinders 58 and 60 to emit heat rays therefrom.

A safety device of the present invention may be incorporated in the oil burner constructed in the manner described. Such a safety device includes a first flame electrode 70. In the embodiment of FIG. 1, first flame electrode 70 is in the form of an electrically conductive rod which is supported by housing 12 and inserted through an opening in top plate 32 into that upper portion of port 14 at which electrode 70 is constantly surrounded by flames formed due to normal combustion. Electrode 70 is electrically insulated from pot 14, and an AC voltage is applied between pot 14 and electrode 70.

The safety device also includes a second flame electrode 72 of an at least two dimensional shape arranged at a location in burner 10 to which a normal combustion flame formed in pot 14 does not extend. In the illustrated embodiment, the red-heated inner perforated cylinder 60 of the oil burner also acts as the second flame electrode 72. In this example, cylinder 60 is formed of an electrically conductive material such as metal and is electrically insulated from outer perforated cylinder 58 by means of a suitable spacer 74 of electrically insulating material. AC voltage is applied between second flame electrode 72 and pot 14. Alternatively, only lower seal plate 62 may be used as the second flame electrode.

Figure 2:
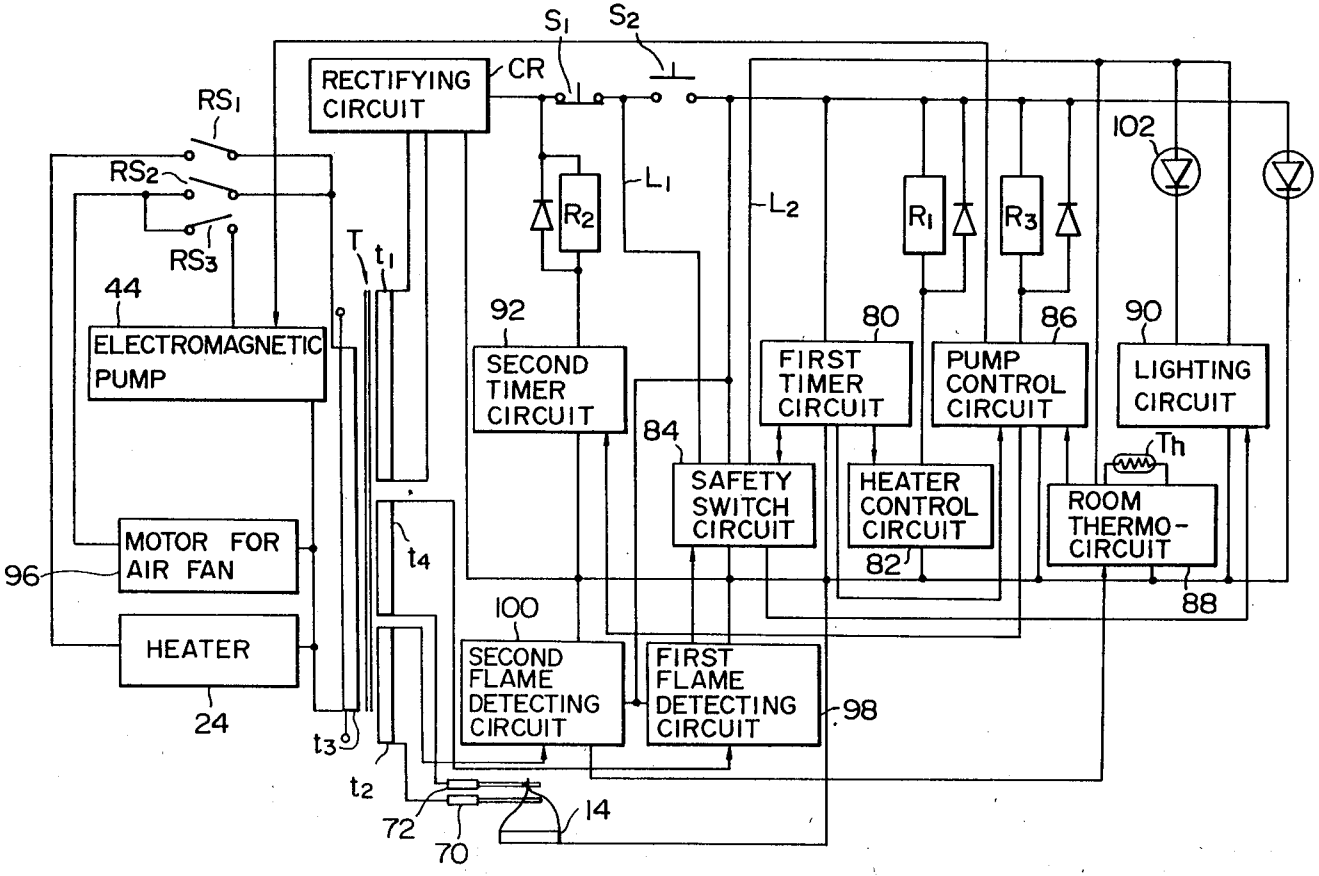
FIG. 2 is a circuit diagram of the safety device used in the oil burner shown in FIG. 1.

The manner of operation of the safety device will be described in relation to the oil burner with reference to FIGS. 1 to 3. In FIG. 2, a power transformer T includes a winding $t_1$ which is connected at both ends thereof with a rectifying circuit CR to form a power supply. $S_1$ is a normally closed push button control switch and $S_2$ is a normally open push button control switch. First, the ignition operation of the oil burner will be described. When switch $S_2$ is closed, electric current is supplied from rectifying circuit CR to a first timer 80, a heater control circuit 82 and a pump control circuit 86. A safety switch circuit 84 includes a known holding circuit, and acts to continue the supply of current from the power source through lines $L_1$ and $L_2$ to first timer 80, heater control circuit 82 and pump control circuit 86 when switch $S_2$ has been opened. At this time, current is not supplied to a room thermo-circuit 88 and a lighting circuit 90. When current is supplied to heater control circuit 82, a relay $R_1$ is actuated to close a relay switch $RS_1$ corresponding thereto, thus, current is fed from an AC power supply (not shown) connected across a winding $t_3$, which acts as the primary winding of transformer T, to heater 24 concurrently with closing of switch $S_2$ to heat pot 14.

First timer circuit 80 starts to count upon closing of switch $S_2$ and feeds an actuating signal to pump control circuit 86 in a predetermined time to allow circuit 86 to operate. The actuation of circuit 86 causes current to flow through a relay $R_3$ to close a relay switch $RS_3$, and concurrently supplies an actuating signal to a second timer circuit 92. This results in current being flowed through a relay $R_2$ to close a relay switch $RS_2$ corresponding thereto. The closing of relay switches $RS_2$ and $RS_3$ allows current to be supplied from an AC power supply (not shown) connected across winding $t_3$ to a motor 96 of air fan 36 and electromagnetic pump 44; so that, motors 96 and pump 44 begin to operate. Thus, the closing of switches $R_2$ and $R_3$ carries out the ignition because heater 24 has previously heated pot 14 to a high temperature.

Pump control circuit 86 includes a timer, which is adapted to actuate electromagnetic pump 44 to supply fuel oil to pot 14 at a flow rate larger than that required during normal combustion operation, for a predetermined period of time after ignition. When the timer of pump control circuit 86 counts the predetermined time, electromagnetic pump 44 starts its normal operation to supply fuel oil at a flow rate lower than that required during ignition.

A winding $t_2$ of power transformer T is electrically connected at one end thereof to first flame electrode 70 and at the other end thereof to the input terminal of a first flame detecting circuit 98. Also, a winding $t_4$ of transformer T is electrically connected at one end thereof to second flame electrode 72 and at the other end thereof to the input terminal of a second flame detecting circuit 100. Flame electrodes 70 and 72 are adapted to detect flame utilizing the rectifying action of flame. In the illustrated embodiment, pot 14 serves as a counter electrode at ground potential. Flame between pot 14 and flame electrodes 70 and 72 causes a DC voltage to appear at the input terminals of first and second flame detecting circuits 98 and 100 due to the rectifying action of the flame, so that the circuits 98 and 100 generate first and second flame detecting signals, respectively.

When first timer circuit 80 counts the predetermined time after switch $S_2$ is closed, safety switch circuit 84 connects room thermo-circuit 88 and lighting circuit 90 with the power source. This results in circuits 88 and 90 being in an actuated state. First timer 80 further carries out counting when a flame detecting signal is supplied to safety switch circuit 84; and after it counts a predetermined time, it supplies to heater control circuit 82 a stop signal for stopping the supply of current to heater 24. This results in heater control circuit 82 stopping the supply of current to relay $R_1$ to cause relay switch $RS_1$ to be opened, to thereby stop the supply of current to the heater.

When flame detecting circuit 98 does not generate or stops the generation of a flame detecting signal, safety switch circuit 84 actuates the lighting circuit 90 to light an alarm lamp 102 indicating the burner has gone out. Also, when first timer 80 detects that a flame detecting signal is not supplied to safety switch circuit 84, it supplies a stop signal to heater control circuit 82 and pump control circuit 86. This causes relay switches $RS_1$ and $RS_3$ to be opened to stop the combustion operation. When alarm lamp 102 is lighted, switch $S_1$ is manually pushed. The re-ignition operation is carried out by pushing switch $S_2$ again.

When abnormal combustion occurs in pot 14 to cause flame to surround or extend to second flame electrode 72, the electrode detects the flame and second flame detecting circuit 100 supplies a second flame detecting signal to room thermo-circuit 88. Room thermo-circuit 88 includes a fuel control circuit which acts to detect a temperature of a room by means of a thermistor Th and to control the flow rate of fuel oil so as to carry out combustion desired in view of the temperature, and supplies to pump control circuit 86 a control signal for controlling the flow rate of fuel oil. In the illustrated embodiment, the supply rate of fuel by pump 44 is controlled by supplying a second flame detecting signal of second flame detecting circuit 100 to room thermo-circuit 88 and using the signal as an input signal for the fuel control circuit of room thermo-circuit 88 to decrease or stop the supply of fuel oil. Alternatively, this may be accomplished without utilizing such fuel control circuit of thermo-circuit 88 by providing a fuel control circuit in second flame detecting circuit 100 and supplying a second flame detecting signal directly to pump control circuit 86.

Now the extinguishing operation of the oil burner will be described. When switch $S_1$ is pushed, safety switch circuit 84 is released from the self holding state to stop the supply of current from the power source to pump control circuit 86 and the like. This causes relay switch $RS_3$ to be opened to stop the actuation of electromagnetic pump 44 to gradually promote the fire-extinguishing. When the supply of current to pump control circuit 10 is stopped, timer 92 starts to count and stops the supply of current to the relay $R_2$ in a predetermined time. This results in the relay switch $RS_2$ being opened to the motor 96, to thereby carry out the extinguising.

Figure 3:
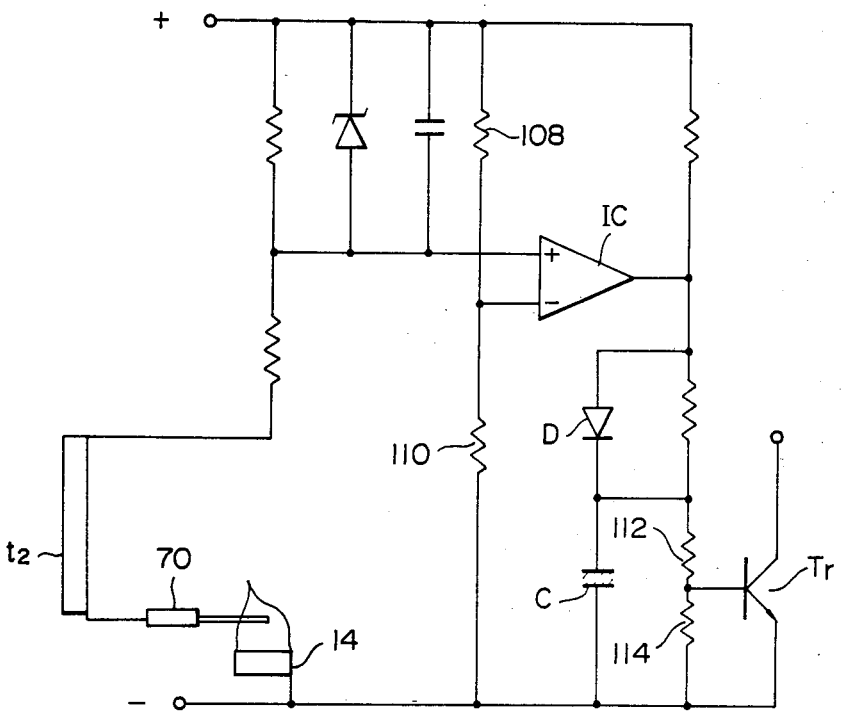
FIG. 3 is a circuit diagram showing one example of a first flame detecting circuit of the safety device shown in FIG. 2.

FIG. 3 shows one example of the first flame detecting circuit. When a flame surrounds or extends to first flame electrode 70, DC current flows between the electrode 70 and pot 14 due to the rectifying action of the flame. Reference voltage is applied to the negative input terminal of a comparator IC which has been obtained by the dividing actions of resistors 108 and 110. Voltage appearing at the positive input terminal of the comparator IC varies depending upon the amount of flame. In order to prevent malfunction of the first flame detecting circuit, reference voltage is applied to the negative input terminal of the comparator to allow a flame detecting signal to be generated when the voltage appearing at the positive input terminal is above a predetermined level.

Comparator IC normally generates an output of an L-level (ground potential), and generates an output of an H-level when voltage of the positive input terminal exceeds a predetermined level. When output of comparator IC reaches an H-level, current flows through the base-emitter circuit of a transistor $T_r$ to supply a flame detecting signal to the collector of transistor $T_r$. A condensor C is charged through a diode D when the output of the comparator IC reaches an H-level. Because voltage applied to the positive input terminal of the comparator is varied, the output of the comparator reaches an L-level at times even when flame is formed. In this instance, the condensor C discharges through resistors 112 and 114 and the base-emitter circuit of the transistor $T_r$ to keep the transistor conductive, to thereby prevent malfunction of the first flame detecting circuit 98. The second flame detecting circuit 100 may be constructed in the substantially same manner as the first one.

Figure 4:
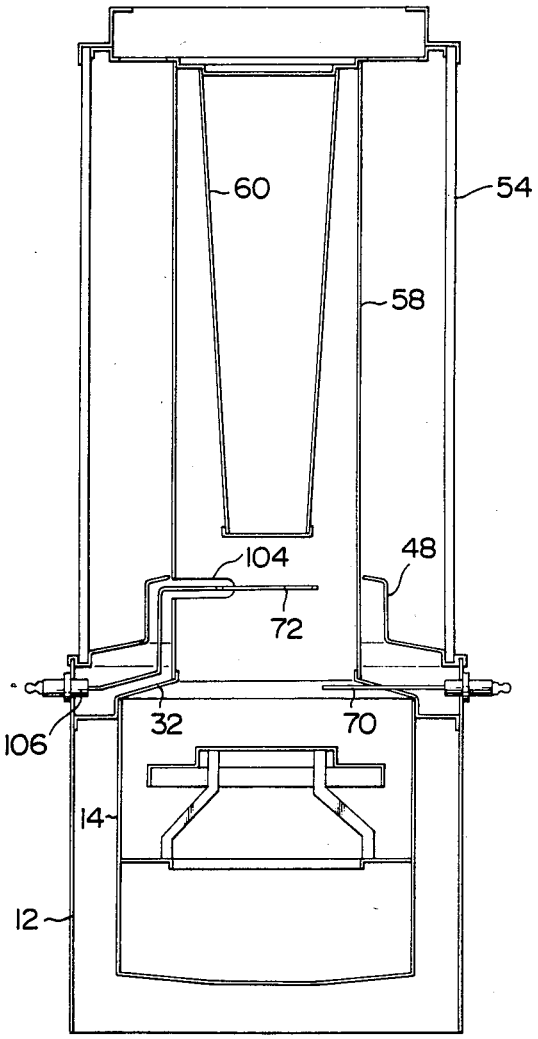
FIG. 4 is a schematic, vertical sectional view showing the essential parts of an oil burner comprising another embodiment of a safety device according to the present invention.

FIG. 4 schematically shows the essential part of an oil burner having a second embodiment of an oil burner embodying a safety device according to the present invention. In the oil burner shown in FIG. 4, outer perforated cylinder 58 is supported on top plate 32 of pot 14 and extends upwardly therefrom, so that the cylinder 58 may serve as a flame guiding cylinder. Top plate 48 of housing 12 extends upwardly in the space between the outer cylinder and heat-permeable cylinder 54 supported on the top plate 48 and terminates at the portion of cylinder 58 positioned somewhat below the lower end of inner perforated cylinder 60. Outer cylinder 58 is formed with an essentially horizontal circumferentially extending slot 104 at a position below the upper end of top plate 48 to which a normal combustion flame does not extend. The remainder of the oil burner shown in FIG. 4 is constructed in the substantially same manner as shown in FIG. 1.

In the embodiment of FIG. 4, a second electrode 72 is formed into a ring shape and inserted through slot 104 of outer cylinder 58. Only the edge of this ring shaped electrode is shown in FIG. 4. The electrode 72 is arranged to be substantially concentric with pot 14, so that it can effectively detect abnormal combustion in pot 14 but does not substantially adversely affect the flow of combustion gas and heat generated in pot 14. The second electrode is led out through an insulator 106 from the housing 12 to the outside. The oil burner including the second embodiment of the safety device of the present invention is operated in the substantially same manner as the oil burner shown in FIG. 1 and detailedly described hereinabove.

As seen from the foregoing, the safety device of the present invention can rapidly and effectively detect and stop abnormal combustion in an oil burner with a simple structure. It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall therebetween.

Having thus described our invention in sufficient detail to enable those skilled in the art to make and use it, we claim as new and desire to secure Letters Patent for:

1. A safety device for an oil burner having a burner body and red-heated cylinder means including an outer perforated cylinder and an inner perforated cylinder arranged above said burner body so as to be red-heated, said safety device comprising:

a first flame electrode positioned in a flame formed during normal combustion in said burner body and electrically insulated from said burner body so as to detect a DC flame current through said first flame electrode;

a second flame electrode having a curved outer edge and arranged in said oil burner so that said curved outer edge extends substantially concentrically with said burner body, said second flame electrode circumferentially occupying a part of the cross section of a passage defined by an annular wall for upwardly guiding through said red-heated cylinder means combustion gas produced in said burner body, and said second flame electrode being insulated from said burner body so as to detect a DC flame current through said second flame electrode;

means for applying an AC voltage between said burner body of said oil burner and said first and second flame electrodes; and, means for extinguishing flames in said burner upon detection of a flame at said second flame electrode.

2. A safety device for an oil burner as defined in claim 1, wherein said second flame electrode has an annular shape arranged concentrically with said burner body.

3. A safety device for an oil burner as defined in claim 2, wherein said burner body is provided at an upper end thereof with an annular flange, said outer perforated cylinder is supported on said flange so as to act as a flame guiding cylinder which upwardly extends from an inner portion of said flange, and said second flame electrode extends through said flame guiding cylinder thereinto.

4. A safety device for an oil burner as defined in claim 1, wherein said second flame electrode is disposed at a position to which said flame formed during normal combustion in said burner body does not extend.

5. A safety device for an oil burner as defined in claim 1, wherein said second flame electrode comprises a circular seal plate at a lower end of said inner perforated cylinder.

6. A safety device for an oil burner as defined in claim 1 further comprising means for stopping the supply of fuel oil to said burner body upon an increase in a DC current flowing through said second flame electrode.

7. A safety device for an oil burner as defined in claim 1, wherein said second flame electrode comprises said inner perforated cylinder.

8. A safety device for an oil burner having a burner body, said safety device comprising:

a first flame electrode extending from said burner body into a flame formed during normal combustion in said burner body and being electrically insulated from said burner body so as to detect a DC flame current through said first flame electrode;

a second flame electrode having an annular shape and arranged substantially concentrically with said burner body and above said burner body, said second flame electrode being electrically insulated from said burner body so as to detect a DC flame current through said second flame electrode;

means for applying an AC voltage between said burner body and said first and second flame electrodes; and, means for extinguishing flames in said burner upon detection of a flame at said second flame electrode.

9. A safety device for an oil burner having a burner body and red-heated cylinder means, said safety device comprising:

a first flame electrode extending from said burner body into a flame formed during normal combustion in said burner body and being electrically insulated from said burner body so as to detect a DC flame current through said first flame electrode;

a second flame electrode arranged substantially concentrically with said burner body and above said burner body, said second flame electrode comprising at least a portion of said red-heated cylinder means and being electrically insulated from said burner body so as to detect a DC flame current through said second flame electrode;

means for applying an AC voltage between said burner body and said first and second flame electrodes; and, means for extinguishing flames in said burner upon detection of a flame at said second flame electrode.

* * * * *